United States Patent [19]

Baus

[11] 4,107,878

[45] Aug. 22, 1978

[54] LATERAL CONNECTION MEMBER OF A PARTITION FOR A BATHING- OR SHOWER-CABIN

[76] Inventor: Heinz Georg Baus, Ulmenweg 46, Thun, Switzerland, CH-3601

[21] Appl. No.: 702,665

[22] Filed: Jul. 6, 1976

Related U.S. Application Data

[63] Continuation of Ser. No. 549,025, Feb. 11, 1975, abandoned.

[30] Foreign Application Priority Data

Feb. 15, 1974 [DE] Fed. Rep. of Germany ..... 2407230

[51] Int. Cl.[2] ..... E05D 15/08; E06B 3/46

[52] U.S. Cl. ..... 49/125; 49/504

[58] Field of Search ..... 49/125, 454, 463, 380, 49/504; 52/241, 729, 732

[56] References Cited

U.S. PATENT DOCUMENTS

| | | | |
|---|---|---|---|
| 2,629,143 | 2/1953 | Spector et al. | 49/380 X |
| 2,707,311 | 5/1955 | Orlin | 49/125 |
| 2,850,089 | 9/1958 | Burke | 49/125 X |
| 2,908,051 | 10/1959 | Sparkes | 49/125 |
| 3,377,747 | 4/1968 | Donkin | 49/463 X |
| 3,423,892 | 1/1969 | Rimington | 52/241 |
| 3,475,870 | 11/1969 | Birum | 52/732 X |
| 3,562,995 | 2/1971 | Zwickert | 52/732 |

FOREIGN PATENT DOCUMENTS

| | | | |
|---|---|---|---|
| 1,509,900 | 8/1969 | Fed. Rep. of Germany | 52/732 |
| 346,015 | 6/1960 | Switzerland | 52/732 |

*Primary Examiner*—Casmir A. Nunberg
*Assistant Examiner*—David H. Corbin
*Attorney, Agent, or Firm*—Herbert L. Lerner

[57] ABSTRACT

In a connection member of a slideable partition including at least one displaceable plate for a tub, the connection member being attached on a side adjoining the slideable partition to the displaceable plate and having first and second sidepieces embracing the plate, a combination including a crosspiece rigid with, and forming a U-shaped member together with the sidepieces and an extension member rigid with the crosspiece and attachable to a wall together with one of the sidepieces extending on the other side of the connection member. The latter either subtends an angle with a wall panel of the slideable partition, or includes a projection member bulging therebeyond, the extension member protruding therefrom within the region of the second sidepiece at an equidistance with the projection member.

3 Claims, 9 Drawing Figures

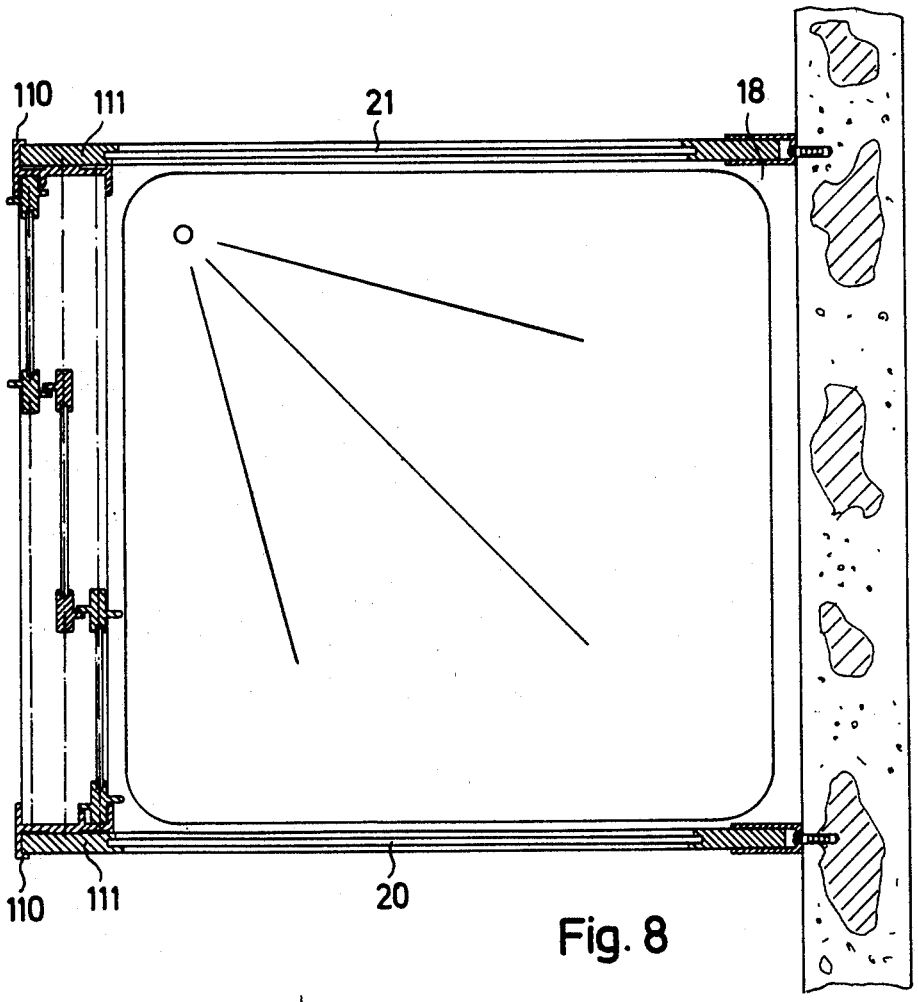
Fig. 8
Fig. 9
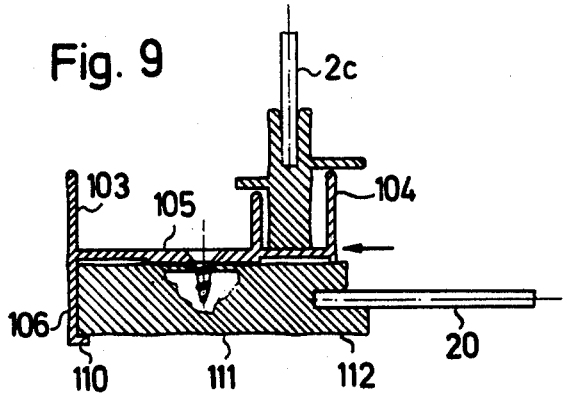

LATERAL CONNECTION MEMBER OF A PARTITION FOR A BATHING- OR SHOWER-CABIN

This is a continuation of application Ser. No. 549,025, filed Feb. 11, 1975, now abandoned.

The invention relates to a lateral connection member or profile of a sliding partition of a bathing or shower cabin, whereby the profile of the side thereof adjoining the displaceable plates or panels of the slideable partition is U-shaped in such a fashion so that the two U-shaped crosspieces embrace these plates.

A known connection member or profile of this type has a U-shaped profile, the open side of which faces the sliding rail of the partition. (See German patent DT-Gmb 7 122 832). Although this connection profile is suitable for attachment to a wall, it is nevertheless dependent on the size of the bathing or shower cabins to be constructed and has to be implemented in different versions.

The slideable partition of the bathing or shower cabin should, on the one hand, be attached firmly between two parallel room-walls. On the other hand, it should be possible, to insert it as part of a corner cabin, the slideable partition being attached to one room wall of a corner and by means of a separation wall to the other wall of that corner. Thirdly, it should be possible to attach a slideable partition by means of two separation walls to a room wall, thus forming a bathing or shower cabin. As a result of such differing construction methods an expensive storage of parts is required.

It is an object of the invention by starting with the connection member of the above-mentioned kind, to selectably shape the same for connection to either a room wall or to a separation wall consisting of wall plates or panels.

The solution, according to the invention, consists in one of the U-crosspieces being extended beyond the U-bar to the other side thereof where there is selectably disposed either:

(a) an extension member equal in length to the projection member of the first U-crosspiece in the region of the second U-crosspiece for attachment to a room wall, or (b) a connection member or profile on the U-bar for attachment of a wall plate or panel, the separation wall subtending an angle with the partition.

Only the two parallel crosspieces face the slide rail, the projection member and the extension member or extension connecting-piece facing away from the slide rail, The box-shaped extension connecting-piece is advantageously insertable on the inner side of an attachment or bulge of the projection member disposed parallel to the U-bar and the surface of the U-bar or rod itself, which in turn serves as a connecting piece to the wall plate or panel of the separation wall, the latter subtending, for example, an angle of 90° with the partition.

The connection member has on its other side a projection member and an extension member having bulges facing each other and being disposed parallel to the U-bar connected by the U-shaped crosspieces for attachment to a rigid room wall, a connection member or profile of this type being substantially an H-shaped member or profile. The separation wall, if viewed from the interior of the cabin or shower, and the respective U-crosspieces form a continous surface with the projection or extension members. Contrary to a known implementation using a simple U-shaped profile, no expansion joint results.

The invention advantageously permits implementation of the connection member or profile along modular principles. The required extension member needed for attachment to a room wall is preferably screwed on by means of a crosspiece disposed parallel to the U-rod and formed into the extension member as a unitary angularly-shaped member or bracket.

Versatile applications of the invention according to the modular principle are possible, as is a versatile insertion of the partitions themselves. The number of the frame profile — or member — parts required is reduced by the shape of the connection member or profile. The required storage and the necessary instruction — and operating-expense is respectively simplified and reduced.

Other features which are considered as characteristic for the invention are set forth in the appended claims.

Although the invention is illustrated and described herein as embodied in a lateral connection member of a partition for a bathing- or shower-cabin, it is nevertheless not intended to be limited to details shown, since various modifications may be made therein without departing from the spirit of the invention and within the scope and range of equivalents of the claims.

The invention, however, together with additional objects and advantages thereof will be best understood from the following description when read in connection with the accompanying drawings, in which:

FIG. 4 shows a plan view of a connection-member in partial section with an extension member screwed on;

FIG. 5 shows a plan view of a connection member in partial section with a box-shaped member screwed on;

FIGS. 6 to 8 are plan views in partial section of bathing or shower cabins with sliding partitions according to FIGS. 1, 2 or 3; and FIG. 9 shows a plan view in partial section of an enlarged version of the lower portion of FIG. 3.

Figure 1:
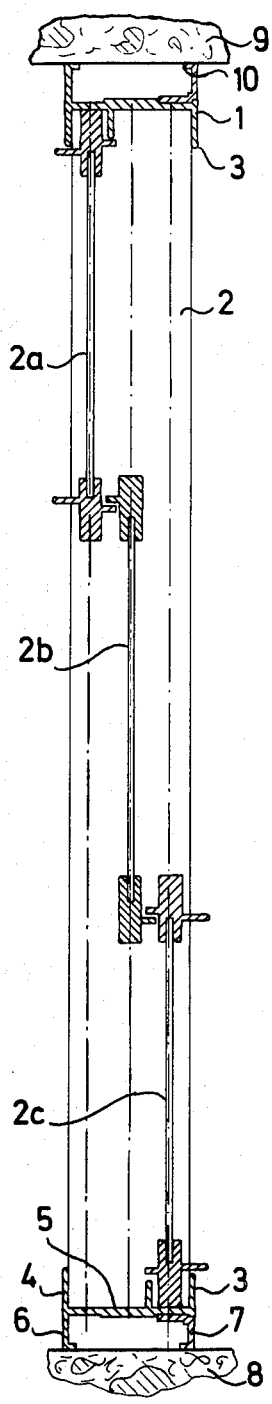
FIG. 1 shows the plan view of a partition disposed between two room walls.
Figure 4:
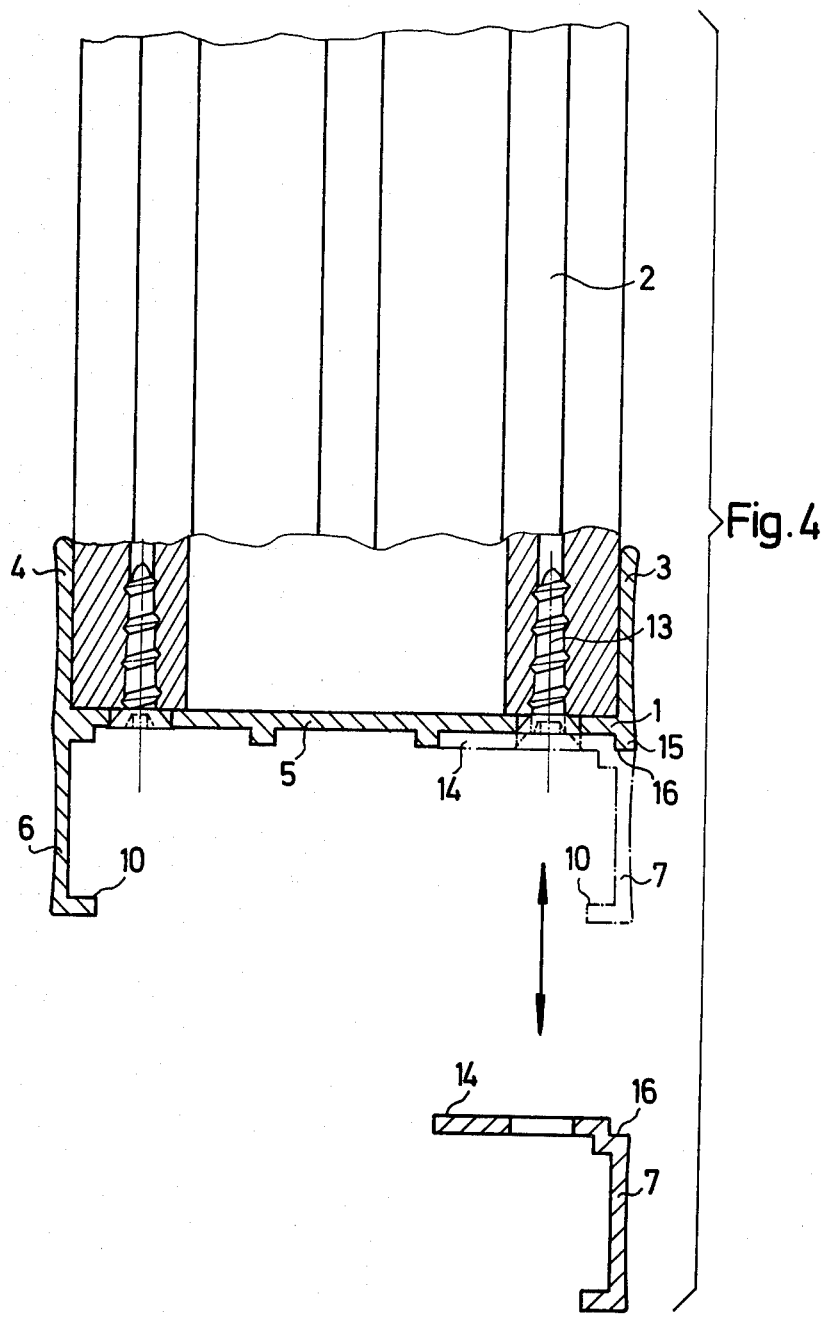
Figure 6:
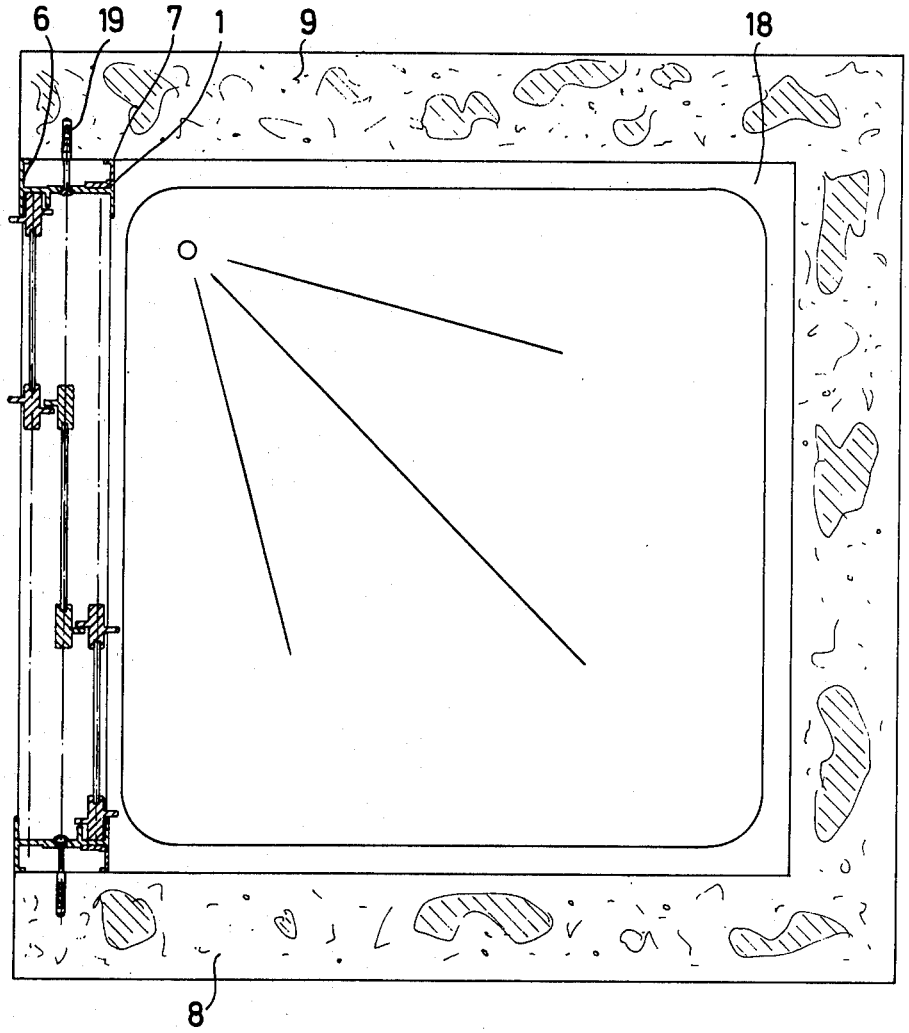

According to FIGS. 1, 4 and 6, a connection member or profile 1, has sidepieces or first limb 3 and second limb 4 extending from a first side of crosspiece 5, facing a slide rail 2. On the second side of crosspiece 5 respectively opposite to parallel sidepieces 3 and 4, there are disposed respective projection member of third limb and extension member or projecting means 6 and 7 attached to respective walls or barrier surfaces 8 and 9 or locked thereto. Members 6 and 7 have respective projection members 10 facing each other and running parallel to the crosspiece 5.

Figure 2:
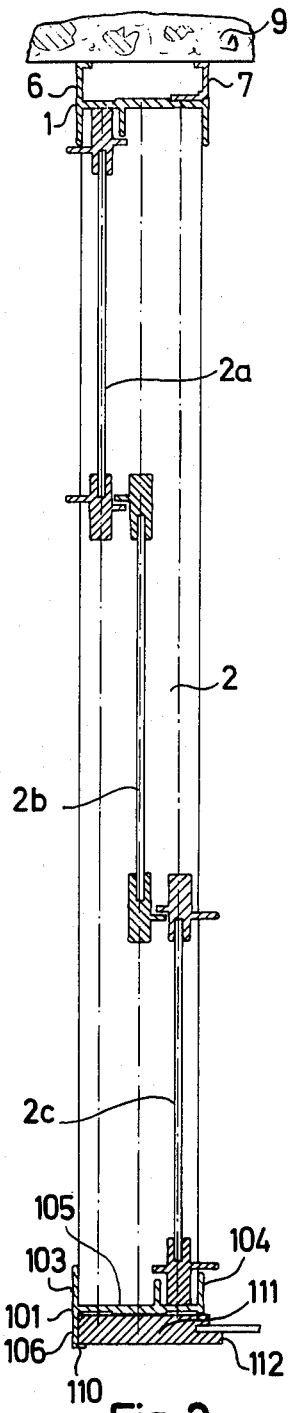
FIG. 2 shows a partition in plan view attached on the one hand to a room wall and on the other hand to a separation wall consisting of wall panels and disposed at right angles to the partition.
Figure 7:
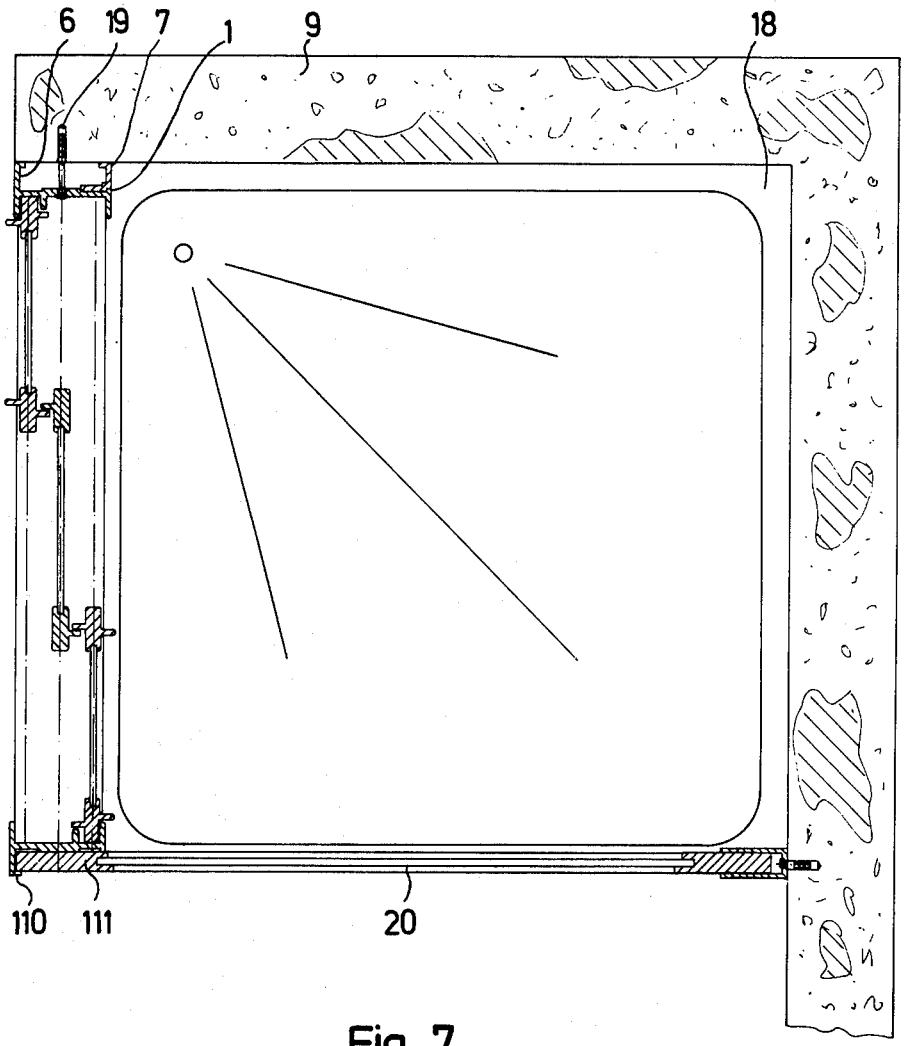

FIG. 2 shows a slideable partition for a corner cabin according to FIG. 7. Between the wall 9 and the slideable partition consisting, for example, of three displaceable or slideable panels or plates *2a*, *2b* and *2c*, there is disposed a connection member or vertical profile 1. On the other side of the slideable partition there is disposed a connection member or vertical profile 101. On the other side of the slideable partition there is disposed a connection member or profile 101 shown enlarged in FIG. 9, side pieces 103 and 104 embracing displaceable panels or plates 2a, 2b and 2c (shown in a collapsed position). The connection member or profile 101 merely has a projection member 106 with a second projection member or bulge 110 disposed or running parallel to the U-shaped 5. Between the inner side of the bulge 110 and the surface of the U-bar 105, there is disposed a box-shaped extension connecting-piece 111, which has a connection rod or bar 112 for a separation wall disposed at right angles to the partition and consisting of additional displaceable plates or panels.

Figure 3:
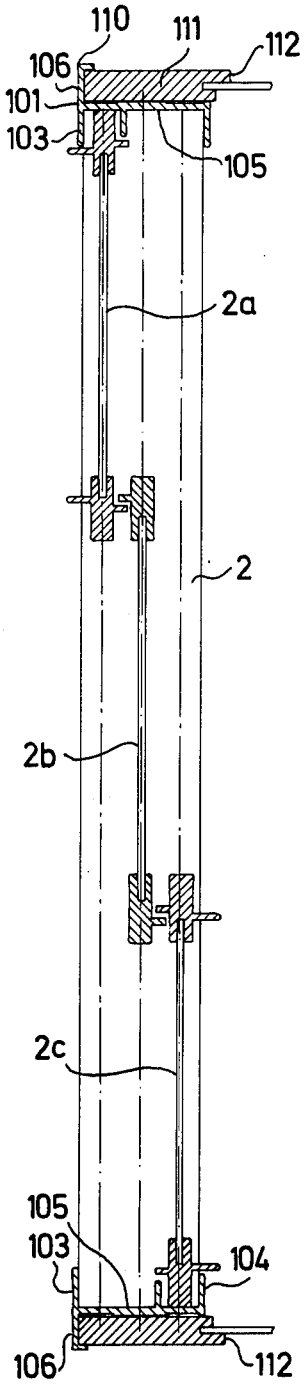
FIG. 3 shows a plan view of a partition, two separation walls being attached at right angles thereto.

FIG. 3 shows a slideable partition to which, as can be seen from FIG. 8, separation walls can be attached on each side consisting of respective displaceable plates or panels. The attachable separation walls have respective profile frame - parts fitting to the connection rods or bars 112.

From FIGS. 1 and 3 it is observable that the slideable partition is suitable for fitting into various types of constructions without its length having to be changed.

According to FIG. 4, the projection member 6 is fitted to the U-bar 5 of the connection member or profile 1. Extension member 7 shown dot-dashed is attachable to the slide rail 2 by means of a self-cutting screw 13. The screw 13 serves in the position shown also for attachment of the connection member or vertical profile 1. Upon attachment of the extension member 7 to the profile 1 by means of a bracket or sidepiece 14 the latter and the connection member or vertical profile 1 are simultaneously tightened. By means of appropriate bulges 15 and recesses 16 of the connection member or profile 1, and of the extension member 7, a suitable and stable attachment is obtained with a first surface of projecting means 7 aligned with the second limb 3 and a second surface of projecting means 7 attached to a portion of crosspiece 5 and third surface 10 or projecting means 7 attached to barrier surface 8.

Figure 5:
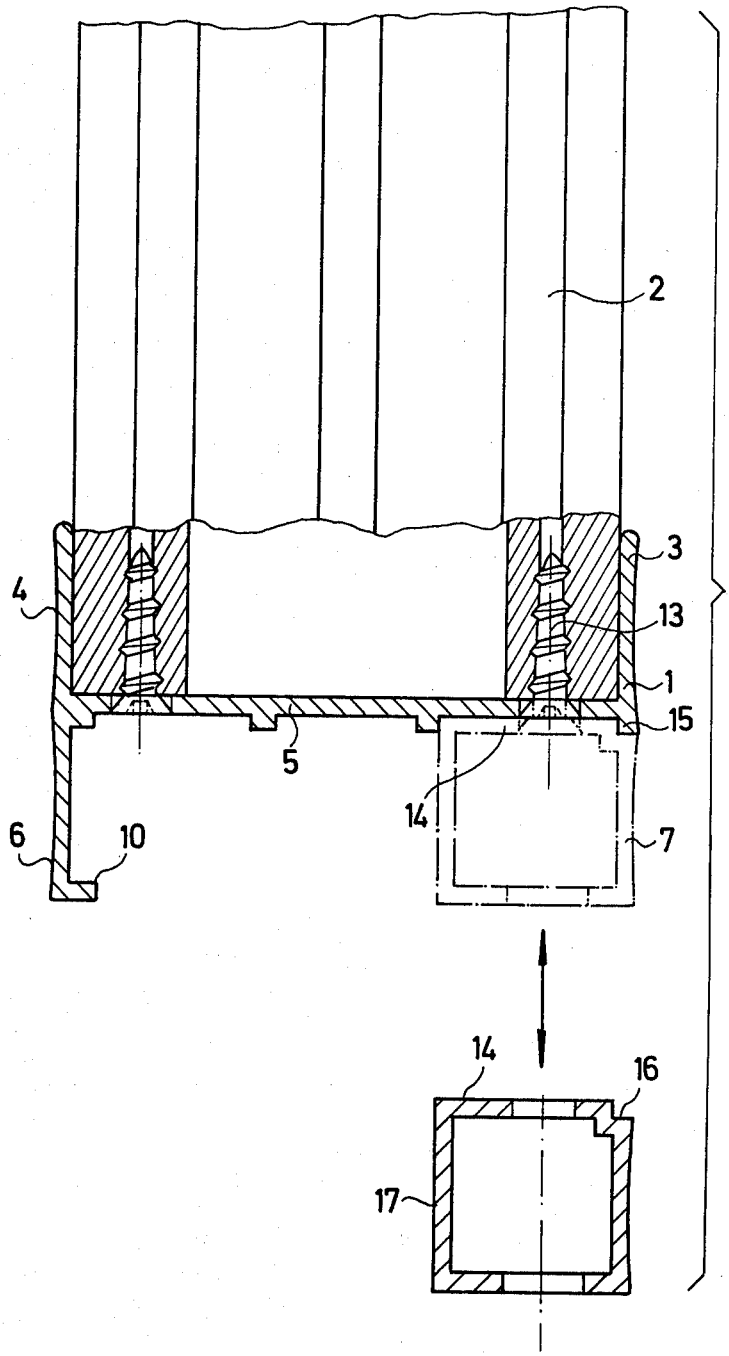

According to FIG. 5, the extension member 7 may be part of a box-shaped extension connecting-piece 17.

FIGS. 6 to 8 show plan views of shower cabins whose shower tubs 18 are square-shaped and have respective side-lengths of, for example, 70 to 80 centimeters.

The slideable partition shown in FIG. 1 is disposed in FIG. 6 between two room walls 8 and 9. Connection members are attached by means of the screws 19 to the room walls 8 and 9.

According to FIGS. 8 and 9, slideable plates 20 and 21 disposed at right angles to the partition are attached by box-shaped extension connecting pieces 111.

FIG. 7 shows the utilization of the construction of FIG. 2, and

FIG 8 shows the utilization of the construction of FIG. 3.

As a result of the invention, the expense of storage is advantageously reduced and a stable attachment to room walls or profile frame-parts of a following partition is achieved. As a result of the shape of the connection member or profile, a pleasing external image is obtained, for the external surface of the respective U-crosspieces 3 and 4 forms a shield and matches with the adjoining surface of the extension member 7 or the projection member 6, so that assembly of a corner is not easily visible from outside.

I claim:

1. Partition apparatus of a bathing or shower cabin, comprising at least one slideable partition; horizontal rail means for guiding sliding of said at least one partition; vertical U-shaped frame members comprising a crosspiece having first and second sides thereof opposite each other, said crosspiece comprising a first and a second projecting limb projecting from said first side and spaced apart so as to define between said first and second projecting limbs a first recess for receiving a terminal portion of said rail means, said crosspiece comprising a third projecting limb, which limb projects from said second side so as to define between said third limb and said crosspiece a second recess, said second recess being capable of receiving a further partition, said third limb being able to be attached to a barrier surface; and the projecting means engageable with or disengageable from a portion of said second side of said crosspiece and having a first surface aligned with the second limb, a second surface attached to said portion of said crosspiece and a third surface being able to be attached to said barrier surface, said portion being located so that projecting means will be spaced apart from said third limb.

2. Partition apparatus according to claim 1, wherein said third limb has a flange projecting from said third limb and parallel to said crosspiece, said flange being located so as to be spaced apart from and project towards said engaged projecting means, said flange being able to engage said barrier surface with said third surface.

3. Partition apparatus according to claim 1, wherein said projecting means for cooperating with said second side of said crosspiece has a box cross section.

* * * * *